United States Patent [19]

Suzuki

[11] Patent Number: 5,011,522

[45] Date of Patent: Apr. 30, 1991

[54] BLOWER FOR THE PRODUCTION OF A MIST OR THE LIKE

[75] Inventor: Toshimitsu Suzuki, Machida, Japan

[73] Assignee: Daichi Canada Inc., Montreal, Canada

[21] Appl. No.: 402,342

[22] Filed: Sep. 1, 1989

[51] Int. Cl.[5] ..... F25J 5/00

[52] U.S. Cl. ..... 62/12; 62/35; 62/388

[58] Field of Search ..... 62/12, 35, 76, 330, 62/384, 388

[56] References Cited

U.S. PATENT DOCUMENTS 3,861,168 1/1975 Sayers ..... 62/388

*Primary Examiner*—Ronald C. Capossela

*Attorney, Agent, or Firm*—McGlew & Tuttle

[57] ABSTRACT

The present invention relates to a blower for the production of a mist or the like (e.g. a smoke, a fog, etc.). The blower comprises a conduit means able to convey liquid carbon dioxide ($CO_2$) and a support means, said conduit means having an inlet means suitable for introducing liquid $CO_2$ therewithin and an outlet means able to discharge liquid $CO_2$ to the atmosphere so as to form a mist or the like, said inlet means being fixed to said support means, characterized in that, said outlet means is rotatably coupled to said inlet means, said outlet means being rotatable about a first axis of rotation.

20 Claims, 3 Drawing Sheets

BLOWER FOR THE PRODUCTION OF A MIST OR THE LIKE

FIELD AND BACKGROUND OF THE INVENTION

The present invention relates to a blower for the production of mist or the like (e.g. a smoke, a fog, a vapour, etc.).

Blowers for the production of a mist, smoke, vapour and the like have been used during stage performances or during the production of films, videos etc. in order to generate a desired aesthetic atmosphere.

Known types of blower devices have consisted of outlet means provided with a discharge element, (such as a discharge horn), which is directly and rigidly fixed to a source of liquid $CO_2$. For example, such a mist may be produced by using a discharge horn which is rigidly connected to a liquid $CO_2$ source via a (high pressure) hose or the like; because of the high pressures involved it has been known to fix the discharge horn to the high pressure hose. This latter type of system is only able to eject or discharge the mist or vapour (e.g. white mist) in essentially a single direction i.e. it is unidirectional. A high pressure hose may be bent but only to a minor angle after which the flow of $CO_2$ is pinched off by the collapse of the hose. A rigid pipe of course cannot be bent at will i.e. immediately on the spot without significant effort. Such non-directional systems are not very attractive.

Accordingly, it would be advantageous to have a device or system from which an artificial mist or the like may be expelled or discharged, at will, in a range of directions.

It would, in particular, be advantageous to have a device or system able to point a discharge horn or the like at will over a range of directions.

SUMMARY OF INVENTION

This, the present invention provides a blower comprising

- a conduit means able to convey liquid carbon dioxide ($CO_2$) and
- a support means said conduit means having
- an inlet means suitable for introducing liquid $CO_2$ therewithin and
- an outlet means able to discharge liquid $CO_2$ to the atmosphere so as to form a mist or the like, said inlet means being fixed to said support means, characterised in that,
- said outlet means is rotatably coupled to said inlet means,
- said outlet means being rotatable about a first axis of rotation.

In accordance with the present invention, the blower may, if desired, have more than one degree of rotational freedom. Thus, for example, the outlet means of the conduit means may comprise two parts (i.e. a first conduit element and a second conduit element) which are also rotatably coupled one to the other. The second conduit element is the part of the outlet means adapted to discharge liquid $CO_2$ to the atmosphere so as to form a mist of the like. In such a case, the first conduit element of the outer part of the conduit means may be rotatably coupled to the inlet means of the conduit means. On the other hand, the second conduit element of the outlet part of the conduit means may be rotatably coupled to this first conduit element, the second conduit element being rotatable about an axis which is transverse to the first axis of rotation (i.e. of the outlet means as a whole). In accordance with this aspect of the invention it can be appreciated that two degrees of freedom with respect to rotation may be available.

If a blower is provided with two degrees of rotational freedom, the first axis of rotation (of the outlet means as a whole) may, if desired, be perpendicular to the axis of rotation of the second conduit element thereof e.g. the first axis of rotation of the outlet means as a whole may be vertical whereas the axis of rotation of the second conduit element thereof may be horizontal.

In accordance with the present invention, the outlet means may be rotatably coupled to the inlet means by a fluid conducting swivel joint. Various swivel joints are known; see for example Canadian patent no. 704,097 as well as U.S. Pat. Nos. 3,088,759, 3,401,956 and 3,627,355. U.S. Pat. No. 3,627,355 is in particular directed to a swivel joint for low temperature use.

In general, a swivel joint may comprise a housing and a hollow rotatable shaft mounted therewithin. The housing may, for example, be provided with a port in fluid communication with the interior of the shaft. Generally, passages are defined in the housing (such as the port) and in the shaft so as to provide fluid communication through these elements regardless of the angular relationship between the passages.

Any suitable sealing means may be used to seal the housing and the shaft relative to each other. The sealing means may, for example, comprise squeeze type packings such as deformable O-rings. However, in accordance with the present invention, the selection of the sealing means should be made keeping in mind that the joint will be subjected to low temperatures and high pressures. Deformable O-rings based on silicone are a preferred sealing means; i.e. silicone rubber O-rings (see U.S. Pat. No. 4,580,794 column 1 lines 10 to 31 which mentions the use of silicone rubbers at low temperatures).

The swivel joints may, if desired, also include any suitable type of bearing means interposed between the housing and shaft in order to facilitate rotations i.e. lower friction.

In accordance with the present invention a swivel joint may, for example, comprise

- a housing having a bore and a radially extending port, the bore passing entirely through the housing and having a central axis,
- a shaft rotatably mounted within the bore and extending entirely therethrough, the axis of rotation of the rotatable shaft being coincident with the central axis of the bore, the rotatable shaft having a bore extending axially partly therethrough, the bore of the rotatable shaft being in fluid communication with the port, and first and second spaced sealing means, the port being disposed between the first and second sealing means,
- each of the sealing means providing a fluid seal between the housing and the rotatable shaft (i.e. means for inhibiting fluid communication).

In accordance with the present invention, the inlet means of the conduit means may be fixed to the housing of the swivel joint so as to be in fluid communication with the port thereof. The outlet means of the conduit means, on the other hand, may be fixed to the rotatable shaft of this swivel joint so as to be in fluid communication with the bore of the rotatable shaft.

In accordance with the present invention, the blower, as mentioned above, may have an outlet means provided with first and second conduit elements. In this case, the first conduit element of the outlet means part of the conduit means may be rotatably coupled to the inlet means by a first fluid conducting swivel joint (e.g. as defined above) and the second conduit element of the outlet part of the conduit means may be rotatably coupled to the first conduit element by a second fluid conducting swivel joint (e.g. also as defined above). Thus, the inlet means of the conduit means may be fixed to the housing of the first swivel joint in fluid communication with the port thereof and the first conduit element of the outlet part may be fixed to the rotatable shaft of the first swivel joint in fluid communication with the bore thereof. The first conduit element of the outlet part of the conduit means may also be fixed to the housing of the second swivel joint in fluid communication with the port thereof, while the second conduit element of the outlet part of the conduit means may be fixed to the rotatable shaft of the second swivel joint in fluid communication with the bore thereof.

In accordance with the present invention, a swivel joint as described above may be provided with first and second spaced sealing means, the port being disposed therebetween. Each of these sealing means may comprise a deformable O-ring, the O-ring being seated in a corresponding (circular) groove disposed on the outer surface of the rotatable shaft. Circular grooves may be disposed about the rotatable shaft so that they are coaxial with the axis of rotation of the shaft (i.e. they are disposed circumferentially about the shaft on each side of the port). The deformable O-rings may, for example, be made of a suitable silicone rubber. If desired, each of the sealing means may comprise a plurality of O-rings; each O-ring may be seated in a corresponding circular groove.

In accordance with the present invention, the outlet means may include a discharge horn for discharging liquid $CO_2$ to the atmosphere to form a mist or the like; the horn may be detachably fixed by any suitable attaching means. The longitudinal axis of the horn may be transverse to the first axis of rotation (of the outlet means); or if two degrees of freedom are present the longitudinal axis of the horn may be transverse to the axis of rotation of the second conduit element.

In accordance with the present invention, rotation of the various parts of the conduit means may be induced, independently or synchronously. Rotation may be induced manually by direct manual manipulation of the various parts of the conduit means or by any suitable manual cranking system; if rotation is to be carried out manually, precautions should be taken to provide the person with protection from cold liquid gas. Alternatively, rotation may be induced by any suitable electromechanical means; this will, for example, facilitate remote operation of the blower.

Electromechanical means for inducing rotation are preferred; such means may include one or more electric motors, a gearing system, etc. as well as any necessary electrical switching means to regulate, as desired, the operation of any such motors e.g. by controlling the flow of electrical power. Electromechanical means are preferred which can be made to operate in a forward or a reverse direction i.e. that can be selectively caused to induce rotation in one direction and then be caused to induce rotation in the opposite direction. Electrical motors, in particular, are preferred which can be selectively made to operate in a forward or a reverse direction i.e. a reversible electric motor that can be selectively caused to operate in a reverse direction so as to induce a corresponding rotation of the element in the opposite (or forward) direction or to operate in a reverse direction so as to induce a corresponding rotation of the element in the opposite (or reverse) direction.

Thus, in general, a blower, in accordance with the present invention, may include an electric motor, the motor being fixed to the support means and being mechanically coupled to the outlet means so as to be able to induce rotation of said outlet means;

and means for effecting operation of the motor to effect or induce rotation of the outlet means.

On the other hand, if a blower, in accordance with the present invention is provided with two degrees of rotational freedom, the blower may, for example, include a first reversible electric motor, the first motor being fixed to the support means and being mechanically coupled to the first conduit element so as to be able to induce rotation of the outlet means, a second reversible electric motor, the second motor being fixed to the first conduit element and being mechanically coupled to the second conduit element so as to be able to induce rotation of the second conduit element, means for selectively effecting operation of the first motor in a forward or reverse direction to effect or induce a corresponding rotation of the outlet means, and means for selectively effecting operation of the second motor in a forward or reverse direction to effect or induce a corresponding rotation of the second conduit element.

Any means suitable for selectively effecting forward or reverse operation of such first and second motors may be utilised. The motors may, for example, be controlled by a suitably adapted computer control system provided with appropriate electric relays and switches. The motors may be made to operate independently or in unison.

If desired, the blower may be provided with braking means to stop or to inhibit rotation of the elements. The breaking means may take any suitable form; if a motor is used it may be selected on the basis that it provide a breaking action.

The means used to rotationally couple elements of the blower, may be adapted so as to provide for complete rotation (i.e. 360 degrees) or for partial rotation only (i.e. 90 degrees, 180 degrees, etc.). If the means used to rotationally couple elements only provides for partial rotations then the means used for inducing rotation must take this limitation into account.

It is to be understood that the details of construction of a blower, in accordance with the present invention, may vary e.g. as a function of the mist effect it is intended to produce. Thus, the materials of construction, the wall thickness of elements such as piping, tubing, joints, etc., number and types of flow control valves such as solenoid type valves, number of degrees of rotational freedom (i.e. number and disposition of swivel joints), electric motors, control systems for regulating rotation of any electric motors, and, if desired, the flow of the gas in liquid form through the conduit means (e.g. computerized systems), the form or design of any discharge horn which may be present, the presence, if desired, of insulation to inhibit heat uptake by the gas in liquid form as it passes through the conduit means, etc. . . may all vary, within the confines of the present invention. In accordance with the type of effect desired, the details of construction will depend on such factors as the size, color and/or shape of the desired plume of mist or the like discharged from the blower, the temperature of operation, the duration of use of the blower, the pressure to which the elements of the blower will be subjected, etc. The present specification is to be read keeping this in mind.

BRIEF DESCRIPTION OF THE DRAWINGS

In drawings which illustrate an embodiment of the invention.

DETAILED DESCRIPTION OF THE PREFERRED EMBODIMENTS

Figure 1:
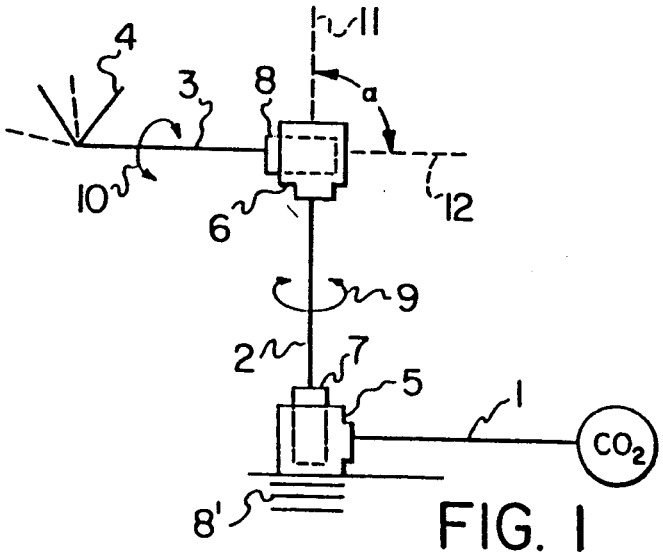
FIG. 1 is a schematic representation of an embodiment which has two swivel joints.

FIG. 1 illustrates in a schematic fashion an embodiment of the present invention wherein the blower is provided with two degrees of rotational freedom. Thus the conduit means, as shown, generally includes three conduit elements namely: an inlet conduit element 1; a first conduit element 2; and a second conduit element 3. The inlet means of the conduit means includes the inlet conduit element 1 whereas the outlet means thereof includes the first and second conduit elements 2 and 3. In the schematic, the second conduit element 3 includes a discharge horn 4.

The conduit elements 1, 2 and 3 may be composed of any suitable type of pipe, tubing, etc. i.e. suitable for the low temperature and high pressure which the blower will be subjected to. The inlet means may, for example, consist of a conduit element 1 which is comprised solely of a coupling element of the swivel joint e.g. the coupling means of the housing of a swivel joint as described in more detail below; the inlet means may, if desired, also include other elements, such as, for example, solenoid valve and tubing combinations for controlling the flow of the cryogenic fluid (e.g. liquid $CO_2$). Any suitable source of liquid $CO_2$ may be connected to the inlet conduit element 1 using any connecting means which will provide fluid communication between the source and the inlet means e.g. piping, flexible pressure hose, solenoid valve and tubing combinations etc.

The blower is also provided with two swivel joints 5 and 6 which serve to couple the elements of the conduit means together so that not only is outlet means as a whole rotatable but the second conduit element is rotatable as well; the second conduit element being able to rotate independently of or synchronously with the rotation of the outlet means as a whole. Thus the inlet conduit element 1 is fixed to the housing of swivel joint 5 and the first conduit element 2 is fixed to the rotatable shaft thereof indicated generally at 7; the first conduit element 1 is conduit element 3 is fixed to the rotatable shaft thereof indicated generally at 8. The housing of swivel joint 5 (and thus inlet conduit element 1) is fixed to a support means indicated generally at 8' (the details of which are not shown); the support means may take any desired form whatsoever.

As can be seen from FIG. 1 the outlet means, as a whole, is rotatable as indicated generally by the arrow 9 whereas the second conduit element is rotatable as indicated generally by the arrow 10. The first axis of rotation 11 of the outlet means is transverse to the axis of rotation 12 of the second conduit element by an angle $\alpha$ which for the purposed of the particular embodiment illustrated in the drawings, is at or about 90 degrees, i.e. they are perpendicular to one another. Using swivel joints of the type discussed herein, and in particular that as shown in FIG. 2, the outlet means and the second conduit element in particular, may each be rotated 360 degrees or more about their respective axii.

Figure 2:
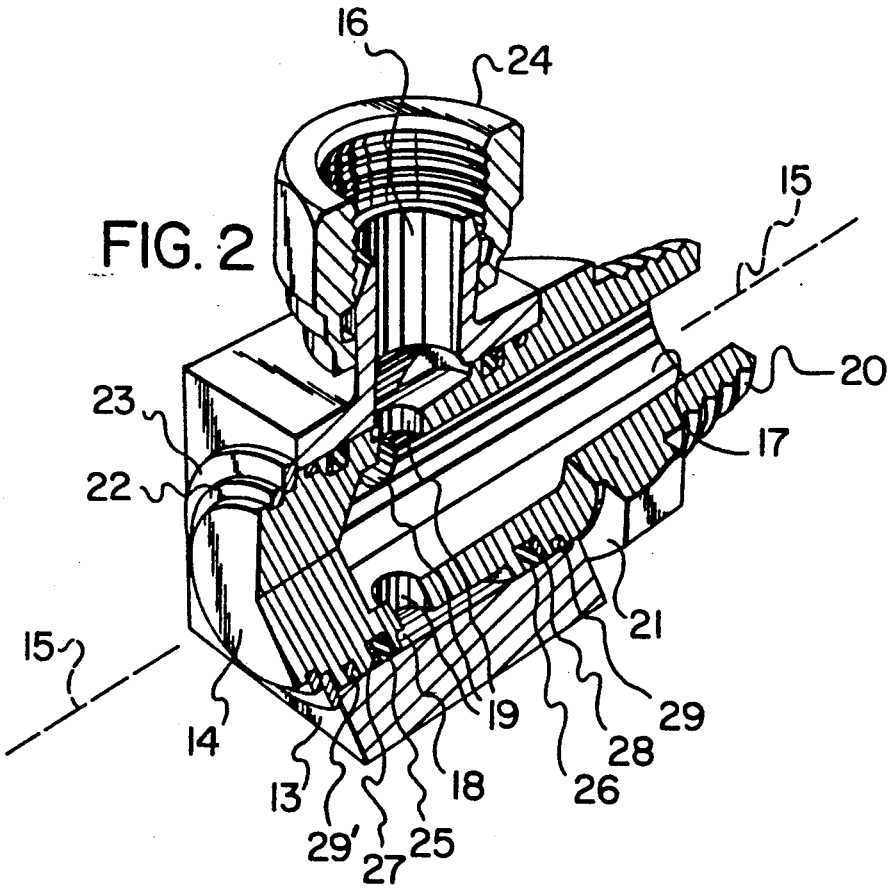
FIG. 2 is a partially cutout perspective view of an example swivel joint.

FIG. 2 illustrates the general structure of a swivel joint which may be used in accordance with the present invention. The swivel joint illustrated basically comprises a housing 13 and a shaft 14 which is rotatably mounted within the central bore of the housing 13. Both the central bore of the housing and the shaft 14 disposed therewithin extend entirely through the housing 13. The diameter of the portion of the rotatable shaft 14 which is disposed within the bore of housing 13 is slightly less than the diameter of the bore. The central axis 15 of the bore and the axis of rotation of the shaft 14 are coincident.

The housing 13 is provided with a port 16.

The rotatable shaft 14 is also provided with a bore 17. The bore 17, however, extends only partly through the rotatable shaft 13. The rotatable shaft 14 is further provided with a recessed annular groove 18 and a plurality of apertures 19; the annular groove and apertures are disposed so that the bore 17 is in fluid communication with the port 16.

The rotatable shaft 14 has an end portion 20 which extends outwardly beyond the bore of the housing 13. The end portion 20 is provided with coupling means in the form of external threads which may be connected to a pipe by any suitable pipe coupling means.

The end portion 20 of the rotatable shaft 14 is also provided with a shoulder stop, indicated generally at 21, which has a diameter which is larger than the diameter of the bore of the housing 13. At the opposite end of the rotatable shaft 14 which also extends beyond the bore of the housing 13 there is a retainer flange 22. The flange 22 may be in the form of a snap ring seated in a corresponding groove disposed in the surface of the shaft 14 to hold the shaft 14 against removal. A washer 23 is also provided to facilitate the retention of the shaft 14 within the bore of the housing 13.

The port 16 also has connected thereto an internally threaded pipe coupler 24 which may be fixed to the port by welding, etc.

Fluid sealing between the housing 13 and the shaft 14 is accomplished by sealing means on each side of the port 16. The illustrated joint is provided with deformable O-ring seals 25 and 26, port 16 being disposed therebetween. These O-rings are seated in corresponding circular grooves disposed on the outer surface of the shaft 14; these circular grooves are coaxial with the axis of rotation of the shaft 14. Backup rings 27 and 28 which are also disposed in these grooves are adapted to exert a suitable pressure on the O-rings to deform them so that the O-rings are urged into sealing engagement with the surface of the bore of the housing 13 and the grooves in which they are disposed; backup rings 27 and 28 may take any suitable form e.g. snap rings. The seals are preferably made of a silicone rubber, the silicone rubber may, for example, comprise dimethylpolysiloxane. Such silicone O-rings have good resistance to low temperatures and high pressure; silicone base O-rings are known which may resist temperatures in the range of −60° C. to 200° C. Silicone O-rings are available from the market. O-rings made of other materials may be used keeping in mind, however, that they are to operate in a low temperature environment (for example, −60° C.).

Dust rings 29 and 29' are also provided in their corresponding grooves in the shaft 14. These rings serve to inhibit the penetration of small particles of dust and the like into the inner working of the joint.

The swivel joint illustrated in FIG. 2 may be used for complete (i.e. 360 degrees) rotation of elements of the blower.

Swivel joints such as those described above are available from Bridgestone Flotech Inc. in Japan (e.g. catalogue no. JL-LD); silicone O-rings for use with such swivel joints may be obtained from the market.

As indicated above other types of swivel joints are known which may be used in accordance with the present invention keeping in mind the sealing requirements at low temperatures and high pressures.

Figure 3:
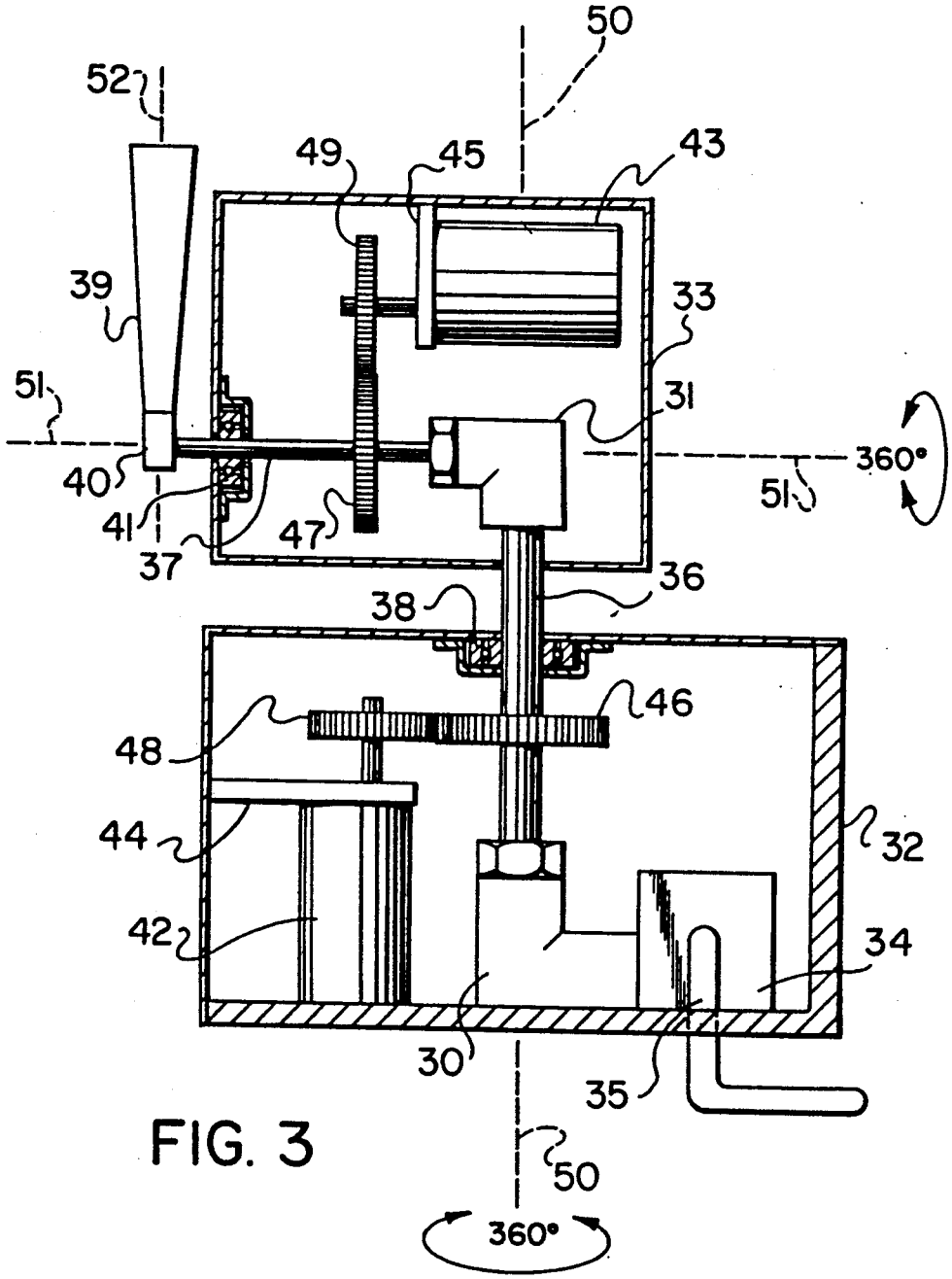
FIG. 3 is a partially cutout sideview of an embodiment of the invention provided with two swivel joints as in FIG. 2 above.

Turning to FIG. 3, it illustrates an example of a blower in accordance with the present invention. The embodiment shown generally reflects the blower scheme described above with respect to FIG. 1. Thus, there are two swivel joints which are indicated generally at 30 and 31; they are disposed within respective casings 32 and 33. These joints are of the same construction and design. The structure of the swivel joints is as described above with respect to FIG. 2; however, other types of swivel joints are known such as, for example, the one referred to in U.S. Pat. No. 3,627,355.

For the embodiment shown in FIG. 3 the conduit means has an inlet means which includes a valve means indicated generally at 34 for controlling the flow of liquid $CO_2$ into the system. The valve means 34 may be of a type which is manually operable, however, for ease of (automatic) operation, an electromagnetic type valve may be used. The valve means 34 may, for example, take the form of a solenoid valve; such valves are available from ASCO (Japan) Co. Limited (e.g. no. X 8223 A 27).

The valve means 34 may be connected via a high pressure hose 35 to a suitable source of liquid $CO_2$ (not shown).

The valve means 34 is also connected to the port (not shown) of the housing of swivel joint 30 via a suitable connecting means (not shown) in the form of a pipe, tubing, coupling joint, etc. The tubing, coupling etc. may be made of iron, stainless steel, etc. keeping in mind that they are to operate in a low temperature and high pressure environment. The housing of swivel joint 30 and/or the valve means 34 is (are) fixed to the bottom support casing 32 by suitable means (not shown).

The conduit means of the shown embodiment has an outlet means which includes a pipe 36 (of the first conduit element thereof) and a pipe 37 (of the second conduit element thereof). For the illustrated embodiment, the pipe 36 must be of sufficiently strong construction since it is fixed to and supports the casing 33 and thus supports the internal components therewithin.

The pipe 36 is connected at one end thereof to the rotatable shaft of the swivel joint 30. The pipe 36 passes through the wall of the casings 32 and 33 and is also connected at the other end thereof to the port of the housing of the swivel joint 31 (e.g. welded to the port). The wall of the casing 32 is provided with a bearing means indicated generally at 38. The bearing means 38 engages the outer surface of pipe 36 to facilitate rotation of the pipe 36. On the other hand, the pipe 36 is fixed to the casing 33 by some suitable means (not shown) such as, for example, by welding or by a mechanical coupling (e.g. bolts, etc.).

The pipe 37 is connected at one end thereof to the rotatable shaft of the swivel joint 31. The pipe 37 passes through the wall of the casing 33 and is also connected at the other end thereof to a discharge horn 39. The horn is fixed to the pipe 37 by some suitable coupling means indicated generally at 40. Preferably, the horn 39 is detachable for ease of replacement. The coupling means may comprise a 90 degree elbow as shown or an elbow of some lesser angle e.g. 45 degree as shown by the dashed outline of a horn 4 in FIG. 1. The elbow is shown in more detail in FIGS. 4*a* and 4*b*.

The wall of the casing 33 is provided with a bearing means indicated generally at 41. The bearing means 41 engages the outer surface of pipe 37 to facilitate rotation of the pipe 37.

The rotation of the pipes 36 and 37 may be accomplished manually by use of a cranking system having a suitable gearing mechanism. However, rotation may be accomplished using one of more electric motors appropriately coupled to the pipes 36 and 37. Thus, the embodiment shown in FIG. 3 includes two electric motors 42 and 43 which may be of the same type or may be different. The motor 42 is fixed to casing 32 by a support bracket 44; and motor 43 is fixed to casing 33 by a support bracket 45. The motors, brackets and casings can be fixed one to the other by any suitable means e.g. bolts.

Motor 42 is associated with pipe 36 and motor 43 is associated with pipe 37. The motors are each mechanically coupled to their associated pipe. In the embodiment shown, mechanical coupling is accomplished by means of ring gears. Thus ring gear 46 is fixedly attached to and externally of associated pipe 36, the axis of rotation of such gear being coincident with the axis of rotation of the pipe; gear 47 is similarly attached to pipe 37. The motors are in turn provided with respective ring gears 48 and 49 which mesh with respective ring gears 46 and 47 for rotating the pipes 36 and 37.

Although toothed ring gears are shown in FIG. 3, other types of gears and coupling means may of course be used such as worm gears, gear reduction means, variable speed gear mechanisms, etc.

The motors may be made to operate independently or synchronously. The motors may be of the reversible kind so as to allow forward and reverse rotation of the pipes. The motors may also be of the "step in" kind in order to facilitate partial as well as continuous rotation of the pipes; suitable motors may be obtained from Oriental Motor Corp. in Japan (e.g. stepping motor PH 266-01).

The blower may be provided with a (remote) electrical control means (not shown) for effecting operation of the motors i.e. to induce and stop rotation, to control the speed of rotation etc.; such control means may include computerised control systems not only for the motors but also for any solenoid valve which may be present.

As can be seen from FIG. 3 the axis of rotation 50 of pipe 36 (first axis of rotation) is coincident with the longitudinal axis of pipe 36. Similarly, the axis of rotation 51 or pipe 37 is coincident with the longitudinal axis of pipe 37. As illustrated the axis of rotation of pipe 36 is perpendicular to the axis of rotation of pipe 37. These axii may, however, be disposed at a different angle provided that the angle would not inhibit the desired rotatability of the various parts of the blower system.

The horn 39 is fixed to the pipe 37 such that it's longitudinal axis 52 is also perpendicular to the axis of rotation 51. As indicated above, this angle may be different (e.g. by using a 45 degree joint elbow), however, it must not be such so as to undesirably inhibit rotation of the horn.

Figure 4A:
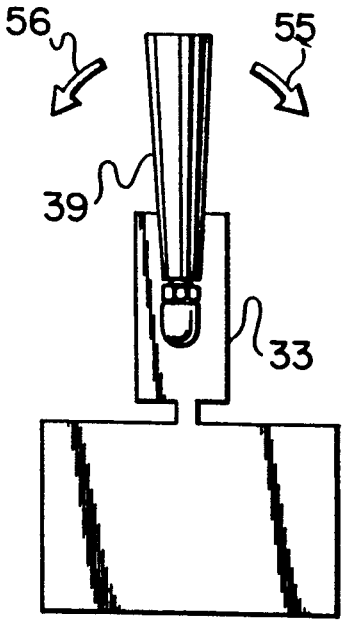
FIG. 4*a* and 4*b* are side views illustrating rotation of elements ' of an embodiment as illustrated in FIG. 3 and are on the same sheet of drawings as FIG. 1.
Figure 4B:
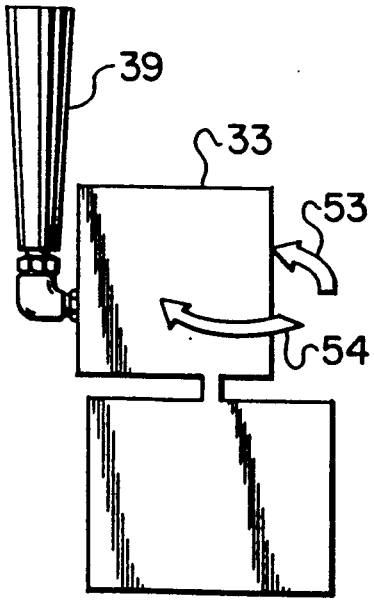

Referring to FIGS. 4*a* and 4*b* (as well as FIG. 3), the rotational operation of the embodiment illustrated in FIG. 3 is shown in a general way. As can be seen from FIG. 4*b* when the pipe 36 is rotated it will induce rotation of the casing 33 (including the horn 39) in the direction of the arrow 53 or in the opposite direction of the arrow 54 as the case may be. On the other hand, referring to FIG. 4*a*, rotation of the pipe 37 will induce rotation of the horn 39 itself in the direction indicated by the arrow 55 or in the opposite direction of the arrow 56 also as the case may be. The horn 39 and the casing 33 can of course, in accordance with the present invention, be made to rotate independently or synchronously. Thus, if desired, either the casing 33 or the horn 39 may be induced to rotate alone. Depending on the system used to induce rotation the casing 33 or the horn 39 may be rotated through only a partial rotation, through a complete rotation or continuously (e.g. 90 degrees of arc, 150 degrees of arc, 360 degrees of arc etc. . . ).

The duration of use of the blower will commonly be from about 20 to 40 seconds. Longer periods of use may be contemplated. In any case, the construction of the blower can take into consideration the duration of use (e.g. whether insulation should be used).

During use the blower as described above with respect to FIG. 3 will of course be coupled to a suitable source of liquid $CO_2$; the liquid $CO_2$ will be caused to circulate through the conduit means as desired; and the rotation of the blower parts will also be controlled as desired in order to get the aesthetic effect that is being sought.

The embodiments of the invention in which an exclusive property or privilege is claimed are as defined as follows:

1. A blower comprising a conduit means able to convey liquid $CO_2$ and a support means, said conduit means having an inlet means suitable for introducing a liquid $CO_2$ therewithin and an outlet means able to discharge liquid $CO_2$ to the atmosphere so as to form a mist of the like, said inlet means being fixed to said support means, characterized in that, said outlet means is rotatably coupled to said inlet means, said outlet means being rotatable about a first axis of rotation and including a first conduit element and a second conduit element, wherein said first conduit element is rotatably coupled to said inlet means, wherein said second conduit element is rotatably coupled to said first conduit element and wherein said second conduit element is adapted to discharge liquid $CO_2$ to the atmosphere so as to form a mist or the like, said second conduit element being rotatable about an axis which is transverse to said first axis rotation.

2. A blower as defined in claim 1 wherein said first axis of rotation is perpendicular to the axis of rotation of said second conduit element.

3. A blower as defined in claim 2 wherein said outlet means is rotatably coupled to said inlet means by a first fluid conducting swivel joint and wherein said second conduit element is rotatably coupled to said first conduit element by a second fluid conducting swivel joint, each of said joints comprising a housing having a bore and a radially extending port, said bore passing entirely through the housing and having a central axis, a shaft rotatably mounted within the bore and extending entirely therethrough, the axis of rotation of said rotatable shaft being coincident with said central axis, said rotatable shaft having a bore extending axially partly therethrough, the bore of said rotatable shaft being in fluid communication with said port, and first and second spaced sealing means, said port being disposed between said first and second sealing means, each of said sealing means providing a fluid seal between said housing and said rotatable shaft, said inlet means being fixed to the housing of said first swivel joint in fluid communication with the port thereof, said first conduit element being fixed to the rotatable shaft of said first swivel joint in fluid communication with the bore thereof said first conduit element being fixed to the housing of said second swivel joint in fluid communication with the port thereof, and said second conduit element being fixed to the rotatable shaft of said second swivel joint in fluid communication with the bore thereof.

4. A blower as defined in claim 3 wherein each of said sealing means comprises a deformable O-ring, said O-ring being seated in a corresponding circular groove disposed on the outer surface of the rotatable shaft, said circular groove being coaxial with the axis of rotation of said shaft and said O-ring being made of a suitable silicone rubber.

5. A blower as defined in claim 4 including a first reversible electric motor, said first motor being fixed to said support means and being mechanically coupled to said first conduit element so as to be able to induce rotation of said outlet means, a second reversible electric motor, said second motor being fixed to said first conduit element and being mechanically coupled to said second conduit element so as to be able to induce rotation of said second conduit element, means for selectively effecting operation of said first motor in a forward or reverse direction to effect a corresponding rotation of said outlet means, and means for selectively effecting operation of said second motor in a forward or reverse direction to effect a corresponding rotation of said second conduit element.

6. A blower as defined in claim 5 wherein the second conduit element includes a detachable horn for discharging liquid $CO_2$ to the atmosphere to form a mist or the like, the longitudinal axis of the horn being perpendicular to the axis of rotation of the second conduit element.

7. A blower as defined in claim 3 wherein the second conduit element includes a discharge horn for discharging liquid $CO_2$ to the atmosphere to form a mist or the like, the longitudinal axis of the horn being transverse to the axis of rotation of the second conduit element.

8. A blower as defined in claim 2 wherein the second conduit element includes a discharge horn for discharging liquid $CO_2$ to the atmosphere to form a mist or the like, the longitudinal axis of the horn being transverse to the axis of rotation of the second conduit element.

9. A blower as defined in claim 1 wherein said outlet means is rotatably coupled to said inlet means by a fluid conducting swivel joint, said swivel joint comprising a housing having a bore and a radially extending port, said bore passing entirely through the housing and having a central axis, a shaft rotatably mounted within the bore and extending entirely therethrough, the axis of rotation of said rotatable shaft being coincident with said central axis, said rotatable shaft having a bore extending axially partly therethrough, the bore of said rotatable shaft being in fluid communication with said port, and first and second spaced sealing means, said port being disposed between said first and second sealing means, each of said sealing means providing a fluid seal between said housing and said rotatable shaft, said inlet means being fixed to said housing in fluid communication with said port, and said outlet means being fixed to said rotatable shaft in fluid communication with the bore of said rotatable shaft.

10. A blower as defined in claim 9 wherein the outlet means includes a detachable discharge horn for discharging liquid $CO_2$ to the atmosphere to form a mist or the like.

11. A blower as defined in claim 9 wherein each of said sealing means comprises a deformable O-ring, said O-ring being seated in a corresponding circular groove disposed on the outer surface of the rotatable shaft, said circular groove being coaxial with the axis of rotation of said shaft and said O-ring being made of a suitable silicone rubber.

12. A blower as defined in claim 1 wherein said outlet means is rotatably coupled to said inlet means by a first fluid conducting swivel joint and wherein said second conduit element is rotatably coupled to said first conduit element by a second fluid conducting swivel joint, each of said joints comprising a housing having a bore and a radially extending port, said bore passing entirely through the housing and having a central axis, a shaft rotatably mounted within the bore and extending entirely therethrough, the axis of rotation of said rotatable shaft being coincident with said central axis, said rotatable shaft having a bore extending axially partly therethrough, the bore of said rotatable shaft being in fluid communication with said port, and first and second spaced sealing means, said port being disposed between said first and second sealing means, each of said sealing means providing a fluid seal between said housing and said rotatable shaft, said inlet means being fixed to the housing of said first swivel joint in fluid communication with the port thereof, said first conduit element being fixed to the rotatable shaft of said first swivel joint in fluid communication with the bore thereof, said first conduit element being fixed to the housing of said second swivel joint in fluid communication with the port thereof, and said second conduit element being fixed to the rotatable shaft of said second swivel joint in fluid communication with the bore thereof.

13. A blower as defined in claim 12 wherein each of said sealing means comprises a deformable O-ring, said O-ring being seated in a corresponding circular groove disposed on the outer surface of the rotatable shaft, said circular groove being coaxial with the axis of rotation of said shaft and said O-ring being made of a suitable silicone rubber.

14. A blower as defined in claim 12 including a first reversible electric motor, said first motor being fixed to said support means and being mechanically coupled to said first conduit element so as to be able to induce rotation of said outlet means, a second reversible electric motor, said second motor being fixed to said first conduit element and being mechanically coupled to said second conduit element so as to be able to induce rotation of said second conduit element, means for selectively effecting operation of said first motor in a forward or reverse direction to effect a corresponding rotation of said outlet means, said means for selectively effecting operation of said second motor in a forward or reverse direction to effect a corresponding rotation of said second conduit element.

15. A blower as defined in claim 14 wherein the second conduit element includes a detachable discharge horn for discharging liquid $CO_2$ to the atmosphere to form a mist or the like, the longitudinal axis of the horn being transverse to the axis of rotation of the second conduit element.

16. A blower as defined in claim 12 wherein the second conduit element includes a discharge horn for discharging liquid $CO_2$ to the atmosphere to form a mist or the like, the longitudinal axis of the horn being transverse to the axis of rotation of the second conduit element.

17. A blower as defined in claim 1 including an electric motor, said motor being fixed to said support means and being mechanically coupled to said outlet means so as to be able to induce rotation of said outlet means, said means for effecting operation of said motor to effect rotation of said outlet means.

18. A blower as defined in claim 1 wherein the outlet means includes a discharge horn for discharging liquid $CO_2$ to the atmosphere to form a mist or the like.

19. A blower as defined in claim 1 wherein the second conduit element includes a discharge horn for discharging liquid $CO_2$ to the atmosphere to form a mist or the like, the longitudinal axis of the horn being transverse to the axis of rotation of the second conduit element.

20. A blower comprising a conduit means able to convey liquid $CO_2$ and a support means, said conduit means having an inlet means suitable for introducing liquid $CO_2$ therewithin and an outlet means able to discharge liquid $CO_2$ to the atmosphere so as to form a mist of the like, said inlet means being fixed to said support means, characteri in that, said outlet means is rotatably coupled to said inlet means, said outlet means being rotatable about a first axis of rotation and including a first conduit element and a second conduit element, wherein said outlet means is rotatably coupled to said inlet means by a fluid conducting swivel joint, said swivel joint comprising a housing having a bore and a radially extending port, said bore passing entirely through the housing and having a central axis, a shaft rotatably mounted within the bore and extending entirely therethrough, the axis of rotation of said rotatable shaft being coincident with said central axis, said rotatable shaft having a bore extending axially partly therethrough, the bore of said rotatable shaft being in fluid communication with said port, and first and second spaced sealing means, said port being disposed between said first and second sealing means, each of said sealing means providing a fluid seal between said housing and said rotatable shaft, said inlet means being fixed to said housing in fluid communication with said port, and said outlet means being fixed to said rotatable shaft in fluid connection with the bore of said rotatable shaft.

* * * * *